US007052254B2

(12) United States Patent
Lin

(10) Patent No.: US 7,052,254 B2
(45) Date of Patent: May 30, 2006

(54) OIL LUBRICANT RETAINING BEARING STRUCTURE FOR A FAN

(75) Inventor: Chi-Hsu Lin, Kaohsiung (TW)

(73) Assignee: Nien-Lun Li, Taoyuan (TW)

( * ) Notice: Subject to any disclaimer, the term of this patent is extended or adjusted under 35 U.S.C. 154(b) by 281 days.

(21) Appl. No.: 10/628,257

(22) Filed: Jul. 29, 2003

(65) Prior Publication Data

US 2005/0025643 A1 Feb. 3, 2005

(51) Int. Cl.
*F04B 35/04* (2006.01)

(52) U.S. Cl. ..... 417/423.12; 417/423.1; 417/423.15; 384/114; 384/107; 384/112

(58) Field of Classification Search ..... 384/114 X, 384/107 X, 112 X, 119, 120; 417/423.1, 417/423.12 X, 423.15
See application file for complete search history.

(56) References Cited

U.S. PATENT DOCUMENTS

| | | | | |
|---|---|---|---|---|
| 4,472,004 | A * | 9/1984 | Fingerle et al. | 384/463 |
| 5,145,266 | A * | 9/1992 | Saneshige et al. | 384/322 |
| 5,441,386 | A * | 8/1995 | Hsieh | 415/230 |
| 6,024,496 | A * | 2/2000 | Shy | 384/279 |
| 6,196,802 | B1 * | 3/2001 | Matsumoto | 416/229 R |
| 6,848,830 | B1 * | 2/2005 | Li | 384/114 |
| 6,890,104 | B1 * | 5/2005 | Gomyo et al. | 384/119 |

* cited by examiner

*Primary Examiner*—Charles G. Freay
*Assistant Examiner*—Emmanuel Sayoc
(74) *Attorney, Agent, or Firm*—Troxell Law Office, PLLC

(57) ABSTRACT

An oil-retaining structure for fan comprises an oily bearing with a central axis hole for pivoting a fan shaft. An oil-collecting recess trench is formed on an inside wall of the central axis hole. There is an acute angle oil-guiding ring edge correspondingly formed at one side of the oil-collecting recess trench. When the fan rotates, lubricant inside the oily bearing is upwardly sucked and blocked by the acute angle oil-guiding ring edge, and returns to the oil-collecting recess trench so as to construct an internal-recycle oil-retaining system.

2 Claims, 3 Drawing Sheets

OIL LUBRICANT RETAINING BEARING STRUCTURE FOR A FAN

FIELD OF THE INVENTION

The present invention is relating to a bearing lubricating structure for DC fan without bushing, more particularly to an oil-retaining structure for fan.

BACKGROUND OF THE INVENTION

The DC fan without bushing has been well known to equip various bearings between fan and fan housing in order to enhance rotation and diminish noise for fan. For example, a ball bearing or an oily bearing (or called self-lubricating bearing) is commonly applied. It has been well known that the oily bearing possesses porous structure made by sintering copper alloy or iron alloy so as to absorb lubricant. However, the lubricant will be forced to sputter due to centrifugal effect to contaminate entire fan housing when the fan shaft in the oily bearing rapidly rotates, and the oil-retaining quantity of oily bearing reduces. Therefore, when the fan is used too long, the lubricating efficiency of bearing becomes bad gradually and noise of bearing becomes loud gradually, even the fan will stop rotating.

It has been well known that a conventional method for preventing losing oily bearing lubricant is to set an oil-retaining ring (or called washer, pad or oil ring) at an end or two ends of the oily bearing. For example, in R.O.C. Taiwan Patent No. 390548 "oil-recovering structure for self-lubricating bearing of a small-sized motor", a washer is set on an end surface of self-lubricating bearing so as to prevent lubricant from spilling. Also, at least a groove is set on the radial surface of self-lubricating bearing, extends to the end surface of self-lubricating bearing, and penetrates to an axis hole. Therefore, although it is unavoidable that the lubricant is sucked out of the self-lubricating bearing by the centrifugal force when a fan shaft rotates, the lubricant flows along the end surface of self-lubricating bearing and the groove of radial surface of self-lubricating bearing while obstructed by the washer, and gradually returns to the self-lubricating bearing. The foregoing oil recovery system is called external-recycle, which is that the lubricant is driven to flow from the axis hole of self-lubricating bearing through the end surface to the radial surface of self-lubricating bearing to distribute over the whole radial surface of the self-lubricating bearing. Then, the high losing rate of lubricant increases the improper loss of lubricant and the risk of fan housing, also the lubricant is turned into muddy oil to slow the rotating speed of fan due to the dust caused by friction of each part.

Another known self-lubricating bearing for DC micro fan without bushing has been disclosed in R.O.C. Patent No. 355037 "improvement of lubricating structure for DC fan bearing without bushing", which is to equip an oil-storing trench at an adequate location inside a pivoting hole (or called axis hole) of self-lubricating bearing as an oil-retaining area. A plurality of recess trenches are set on a pivoting base of a fan housing (i.e. outside the radial surface of self-lubricating bearing) to form an oil-storing area and an oil-retaining cover (i.e. oil-retaining ring) is set on an end surface of oily bearing corresponding to a fan shaft. Therefore, when the fan rotates a lubricant is still driven to flow from the oil-storing trench to the pivoting base recess trench on the fan housing outside the oily bearing, then, an external-recycle oil-recovery system is formed. However, the oil-retaining cover only can decrease overflow of lubricant, although the self-lubricating bearing is surface pivoted to the pivoting base of the fan housing, it still cannot obstruct overflow of lubricant and the lubricant leaks at the bottom of pivoting surface so that the oil-retaining ability is not improved efficiently.

SUMMARY

The primary object of the present invention is to provide a fan oil-retaining structure with acute angle oil-guiding ring edges correspondingly formed at a top and a bottom side of an oil-collecting recess trench in an oily bearing so as to guide the lubricant flowing back the oil-collecting recess trench when the fan shaft rotates. Due to centrifugal force of the fan shaft, the lubricant flows along the returning path with a low pressure that is created by the acute angle oil-guiding ring edge which touches the fan shaft without overflowing outside the oily bearing, so that an excellent internal-recycle oil-recovery system can be obtained without oil-retaining ring for cost down.

The secondary object of the present invention is to provide a fan oil-retaining structure with acute angle oil-guiding ring edges correspondingly formed at a top and a bottom side of an oil-collecting recess trench in an oily bearing. The lubricant inside oil-collecting recess trench isn't lost from the oily bearing even improper place or lean of the oily bearing for enhancing storage or greater oil-retaining efficiency while storing or conveying the fan.

According to the fan oil-retaining structure of the present invention, an oily bearing is set on a fan housing and has a central axis hole for pivoting a fan shaft. An oil-collecting recess trench is formed in the central axis hole of the oily bearing and has acute angle oil-guiding ring edges correspondingly formed at its two sides. A lubricant upwardly sucked by centrifugal force when rotating the fan shaft and is guided along a low pressure returning path which is created by touching the oil-guiding ring edge and the fan shaft, so that the lubricant flows back the oil-collecting recess trench. Therefore, an internal-recycle oil-retaining system is formed by the oil-connecting recess trench and the oil-guiding ring edge.

DETAILED DESCRIPTION OF THE PRESENT INVENTION

Figure 1:
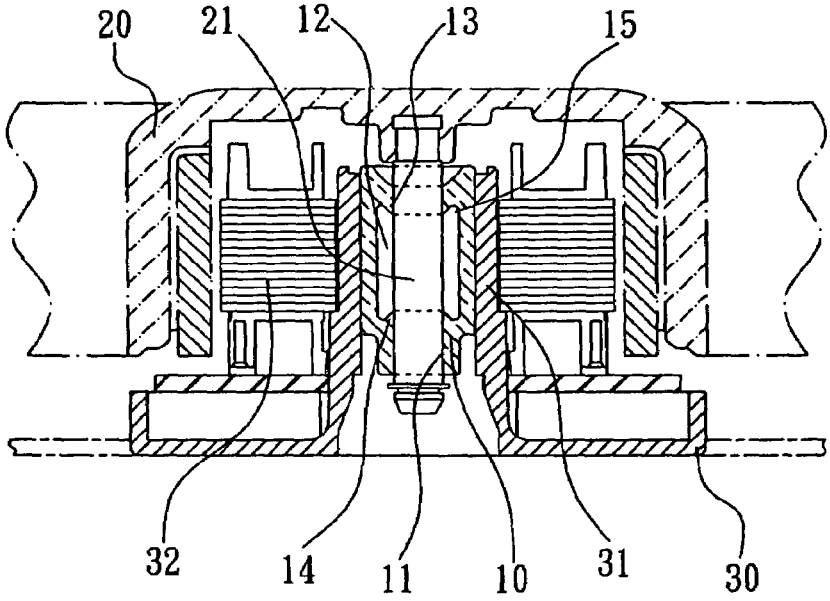
FIG. 1 is a cross sectional view of a fan assembly with a fan oil-retaining structure in accordance with the present invention.

Referring to the drawings attached, the present invention will be described by means of the embodiments below.

Figure 2:
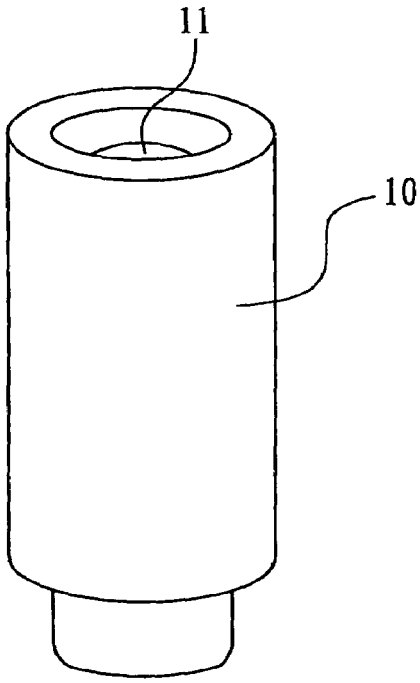
FIG. 2 is a perspective view of a fan oil-retaining structure in accordance with the present invention.

In relation to the structure of the present invention, referring to FIG. 1 and FIG. 2, a fan oil-retaining structure is improved about bearing of micro fan, which comprises an oily bearing 10 to install inside a DC fan without bushing so as to rotate a fan shaft 21 of a fan 20.

Figure 3:
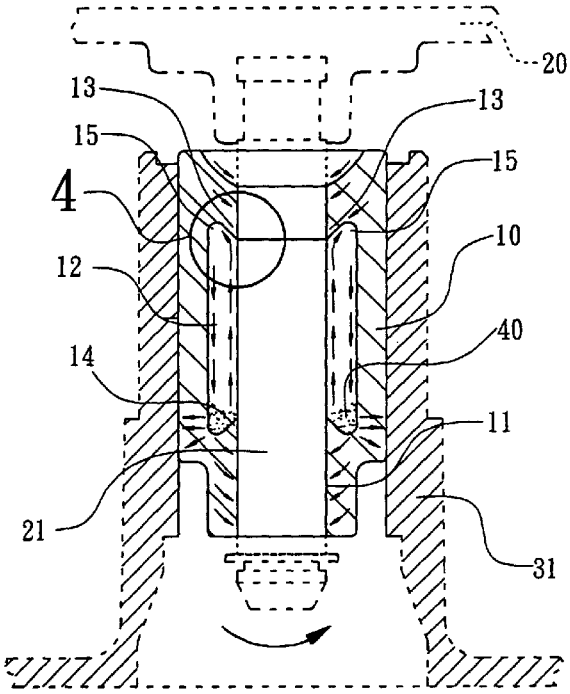
FIG. 3 is a cross sectional view of an oil-retaining internal-recycle when the fan is rotating in accordance with the fan oil-retaining structure of the present invention.
Figure 4:
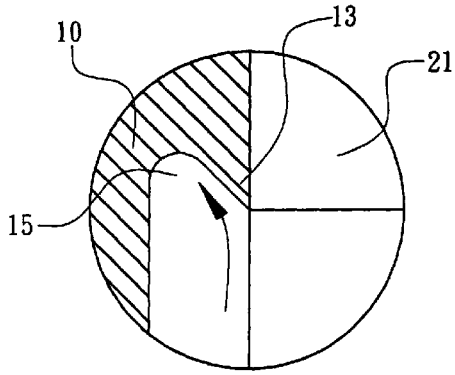
FIG. 4 is a partially cross sectional view of FIG. 3 Part 4 in accordance with the fan oil-retaining structure of the present invention.

A proper quantity of lubricant 40 is stored inside the oily bearing 10 and the oily bearing 10 has a central axis hole 11 for pivoting the fan shaft 21 of the fan 20. An oil-collecting recess trench 12 are formed on the inside wall of the central axis hole 11 in the oily bearing 10 so as to store the lubricant 40. An acute angle oil-guiding ring edge 13 is formed at one side of the oil-collecting recess trench 12 and another acute angle oil-guiding ring edge 14 is formed at the other side of the oil-collecting recess trench 12. Referring to FIG. 3, an internal-recycle oil-retaining system is formed by the oil-collecting recess trench 12 and the acute angle oil-guiding ring edges 13 and 14 when the fan shaft 21 rotatably touches the acute angle oil-guiding ring edges 13 and 14.

The oily bearing 10 is set in a fan housing 30 having a pivoting base 31 (or called fan base). A plurality of stators 32 like coil, circuit board are set at the perimeter outside the pivoting base 31 for magnetically driving the fan 20 to rotate.

Figure 5:
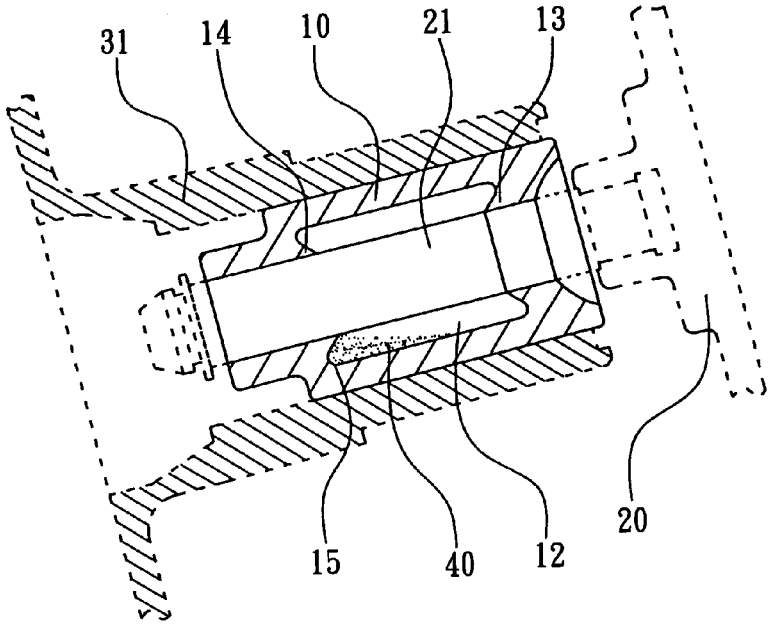
FIG. 5 is a cross sectional view of the fan oil-retaining structure in inclined state of the present invention.

Referring to FIG. 1 and FIG. 3, when the stators 32 in the fan housing 30 are powered on to be magnetized, the fan 20 rotates and the fan shaft 21 pivoted to the oily bearing 10 also rotates. Therefore, the lubricant 40 stored inside the oily bearing 10 is sucked due to centrifugal force caused by the rotating fan shaft 21 and releases from the oil-collecting recess trench 12. Referring to FIG. 5 as indicated by arrowhead, the lubricant 40 will be drawn by the rotating fan shaft 21 to ascend and blocked by the acute angle oil-guiding ring edge 13 while the fan shaft 21 rotatably touching the acute angle oil-guiding ring edge 13 to cause a larger pressure formed on the path of ascending direction. Then, the lubricant 40 is guided by the oblique path with a smaller pressure formed by the acute angle oil-guiding ring edge 13 and the fan shaft 21 to flow back to an inner recess round trench 15 of the oil-collecting recess trench 12 and is able to return to the oily bearing 10. Furthermore, even the excess lubricant 40 can be re-gathered through the acute angle oil-guiding ring edge 14 of the oil-collected recess trench 12, so that an internal-recycle oil-retaining system for oily bearing is formed. Therefore, since the lubricant 40 is uneasy to be pulled out of the oily bearing 10, it is unnecessary to install a conventional oil-retaining ring between the fan shaft 21 and the oily bearing 10 for reaching the efficiencies of oil-retaining without causing muddy oil and non-rotating.

Referring to FIG. 5, when the micro fan inclines due to storing or conveying carelessly, the acute angle oil-guiding ring edge 13 or the acute angle oil-guiding ring edge 14 of the oily bearing 10 is able to enhance oil-retaining and oil-collecting ability of the oil-collecting recess trench 12, and an excellent internal-recycle oil-retaining efficiency can be obtained without losing the lubricant 40 due to inclination.

Figure 6:
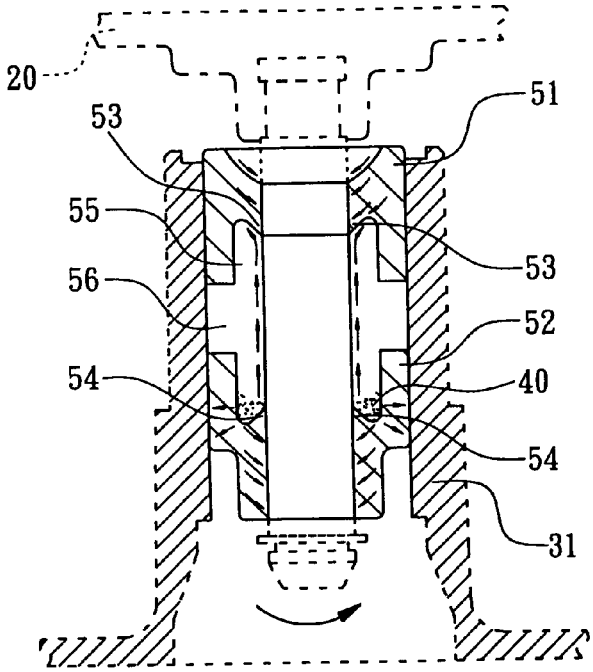
FIG. 6 is a cross sectional view of another equal fan oil-retaining structure of the present invention.

Referring to FIG. 6, in another equal use of the present invention, an oily bearing 50 is composed of an upper bearing 51 and a lower bearing 52. The upper bearing 51 and the lower bearing 52 are set on the pivoting base 31 of the fan housing and which keep an oil-retaining interval 56 without touching each other so as to form a bigger area of oil-collecting recess trench 55 inside the central axis hole of the upper bearing 51 and the lower bearing 52 for storing more lubricant 40. Besides, a greater assembly that the oil-retaining interval 56 between the upper bearing 51 and the lower bearing 52 can be adjusted to match different kinds of pivoting base 31 of the fan housing is a merit. Furthermore, the oily bearing 50 may also lower material cost. An acute angle oil-guiding ring edge 53 is formed one side of the upper bearing 51 and an acute angle oil-guiding ring edge 54 is formed one side of the lower bearing 52 for blocking and guiding the lubricant 40 to flow back.

The above description of embodiments of this invention is intended to be illustrated and not limiting. Other embodiments of this invention will be obvious to those skilled in the art in view of the above disclosure.

What is claimed is:

1. An oil lubricant retaining bearing structure for retaining a lubricant lubricating a fan in a fan housing, the oily bearing structure comprising:

an oily bearing having:

a) a central axis hole, a fan shaft of the fan being rotatably inserted into the central axis hole; and b) an internal-recycle oil-retaining system having:

i) an oil collection trench formed around an interior surface of the central axis hole;

ii) an acute angle oil-guiding ring edge located on each of two opposing ends of the oil collection trench; and iii) two round inner recess trenches, one of the two round inner recess trenches being formed on each of two opposing ends of the oil collection trench adjacent to each acute angle oil-guiding ring edge, wherein the internal-recycle oil-retaining system providing a reservoir for the lubricant.

2. The oil lubricant retaining bearing structure according to claim 1, wherein the oily bearing including an upper bearing, a lower bearing spaced apart from the upper bearing a predetermined distance, and an oil-retaining interval located between the upper bearing and the lower bearing and communicating with the oil collection trench.

* * * * *